PFR49 XR 4,340,370

United States Patent [19]

Marshall et al.

[11] 4,340,370

[45] Jul. 20, 1982

[54] LINEAR MOTION AND POP-UP TARGET TRAINING SYSTEM

[76] Inventors: Albert H. Marshall, 9154 Bay Point Dr., Orlando, Fla. 32811; Bon F. Shaw, 419 Selkirk Dr., Winter Park, Fla. 32792; Paul D. Grimmer, 1250 S. Pennsylvania Ave., Winter Park, Fla. 32789; Herbert C. Towle, 206 Ranch Rd., Maitland, Fla. 32751; Gary M. Bond, 305 E. Jersey St., Orlando, Fla. 32806

[21] Appl. No.: 185,047

[22] Filed: Sep. 8, 1980

[51] Int. Cl.[3] ..... F41G 3/26

[52] U.S. Cl. ..... 434/22; 273/368; 273/312; 273/369; 273/371

[58] Field of Search ..... 434/22; 273/310, 312, 273/366, 367, 390, 391, 392, 368, 369

[56] References Cited

U.S. PATENT DOCUMENTS

| | | | |
|---|---|---|---|
| 2,269,258 | 1/1942 | Falkenberg | 273/312 |
| 2,310,084 | 2/1943 | Hooker et al. | 273/312 |
| 3,964,178 | 6/1976 | Marshall et al. | 434/22 X |
| 4,076,247 | 2/1978 | Kim et al. | 273/366 |

*Primary Examiner*—William H. Grieb

*Attorney, Agent, or Firm*—Robert F. Beers; Robert W. Adams; David S. Kalmbaugh

[57] ABSTRACT

A linear motion and pop-up target training system is disclosed for training a marksman to fire a simulated weapon. Located upon the terrain surface of a model-board are six pop-up targets and three bi-directional linear motion targets, each of which emits, when activated by a first microprocessor computer, a pulsed beam of infrared light. Mounted upon the weapon is a sensor which will sense the pulsed beam of infrared light emitted by the activated target. The sensor then supplied to a rifle electronics circuit an analog signal proportional to the amount of light received by the sensor, and the rifle electronics circuit converts the analog signal to a digital logic signal to be supplied to a second microprocessor computer. The second microprocessor computer then processes the digital logic signal in accordance with a predetermined computer program so as to determine whether the marksman has scored a hit, a miss, or a near miss upon the activated target.

17 Claims, 10 Drawing Figures

| SUBPROGRAM TRUTH TABLE | | | |
|---|---|---|---|
| SUBPROGRAM NUMBER | SWITCHES CLOSED CLOSED=1 OPEN=0 | | |
| | 51 | 49 | 47 |
| ONE | 0 | 0 | 0 |
| TWO | 0 | 0 | 1 |
| THREE | 0 | 1 | 0 |
| FOUR | 0 | 1 | 1 |
| FIVE | 1 | 0 | 0 |
| SIX | 1 | 0 | 1 |
| SEVEN | 1 | 1 | 0 |
| EIGHT | 1 | 1 | 1 |

FIG. 6

LINEAR MOTION AND POP-UP TARGET TRAINING SYSTEM

BACKGROUND OF THE INVENTION

1. Field of the Invention

This invention relates generally to training simulators. In particular, this invention relates to a linear motion and pop-up target training system which allows a marksman to fire a weapon without the requirement of live ammunition.

2. Description of the Prior Art

Heretofore, numerous light responsive targets have been used in shooting galleries and other places. Such devices of the prior art are generally coin released for operation and used for amusement purposes in testing the aiming skill of a marksman who employs a light ray shooting rifle which is aimed at a moving target. The target, in turn, includes a light responsive means such as a photoelectric cell which, when hit by the marksman, will cause the target to change direction.

Thus the target, through a game playing cycle, always moves in the same manner, and a marksman soon achieves such skill in hitting the target that interest is lost.

U.S. Pat. No. 3,964,178 to Albert H. Marshall (one of the inventors of this invention), Frank J. Oharek, John H. Dillard, and Robert J. Entwistle is closest known prior art of the instant invention. A universal infantry weapons trainer is disclosed therein in which frames of motion picture film are employed to produce simultaneously from one set of frames a background area which includes a target, and, from another set of frames, an infrared lead spot. The sets of film frames are coordinated in projection and in a desired degree of nonregistration between the lead spot and the target, so as to provide a lead in the infrared spot that is representative of the correct lead, and an indication of whether or not a weapon is properly aimed. Also disclosed is a receiver circuit comprising a quadrant arrangement of infrared detectors for sensing the infrared lead aim spot combined with amplifiers, comparators, logic and means for indicating a bullseye "hit" on a target or a specific area of near miss relative to the target.

Unfortunately, the aforementioned devices of the prior art ordinarily leave something to be desired, especially from the standpoints of accuracy, complexity, and target information efficiency. Moreover, with respect to the former, sophistication and, hence, the quality thereof only need be that which is sufficient for entertainment purposes, while the latter does not operate in the same manner as the subject invention, and contains a combination of elements that is different from that of the present invention.

SUMMARY OF THE INVENTION

The subject invention overcomes some of the disadvantages of the prior art, including those mentioned above, in that it comprises a relatively simple linear motion and pop-up target training system which is responsive to laser light pulses, rather than being responsive to ordinary light, or other less coherent, concentrated, and intense types of radiant energy. Thus, vastly improved marksmanship is the result of the use thereof for any given expenditure of time and money, as far as the training of a marksman is concerned.

Included in the subject invention is a modelboard which has on the terrain surface thereof six pop-up targets and three bidirectional linear motion targets. Mounted upon each pop-up target is a photodiode which emits therefrom, when activated, a pulsed beam of infrared light. Similarly, mounted upon each linear motion target is a pair of laser light beam photodiodes, the first of which is activated when the target moves to the right upon the modelboard and the second of which is activated when the target moves left upon the modelboard.

A first microprocessor computer, in accordance with a computer program utilized thereby, activates, in a predetermined sequence, each of the linear motion and pop-up targets of the subject invention so as to allow a marksman to aim and fire a simulated weapon at the aforementioned targets. Mounted upon the weapon is a sensor which, when the weapon is correctly aimed at the linear motion or pop-up target currently being activated, will sense the pulse laser light beam emitted from the aforementioned target. The sensor will then supply to a rifle electronics circuit in analog signal proportional to the amount of infrared light received by the sensor. The rifle electronics circuit, in turn, converts the analog signal to a digital logic signal which is then processed by a second microprocessor computer so to determine whether the marksman has scored a hit, a miss, or a near miss upon the target. A voice unit, responsive to the processing of the aforementioned digital logic signal by the second microprocessor computer, will then supply, through a head phone worn by the marksman, an audio message indicative of whether the marksman has scored a hit, a miss, or a near miss upon the target.

BRIEF DESCRIPTION OF THE DRAWINGS

FIG. 6 is a truth table utilized to decode the sequence select inputs of the microprocessor computer which controls the sequencing of the targets of FIG. 1.

DESCRIPTION OF THE PREFERRED EMBODIMENT

Figure 1:
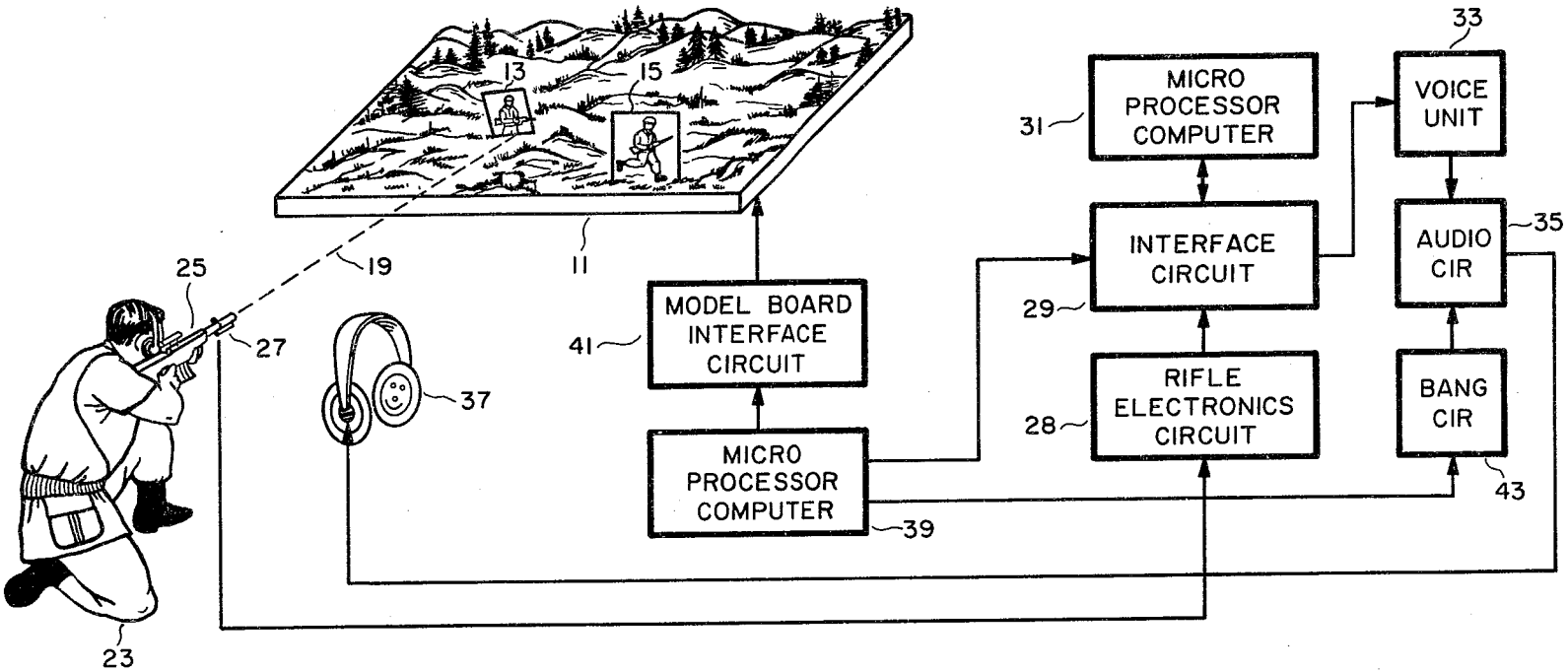
FIG. 1 is a schematic diagram of the linear motion and pop-up target training system constituting the subject invention.

The preferred embodiment of the subject invention will now be discussed in some detail in conjunction with all of the figures of the drawing, wherein like parts are designated by like reference numerals, insofar as it is possible and practical to do so.

Referring now to FIG. 1, there is shown a modelboard 11 which has on the terrain surface thereof six pop-up targets 13, only one of which is illustrated in FIG. 1, and three bidirectional linear motion targets 15, only one of which is shown in FIG. 1. Mounted upon each of the aforementioned pop-up targets 13 is a photodiode 17, FIG. 3, which is adapted for emitting a pulsed infrared light beam 19. Similarly, mounted upon each of the linear motion targets 15 are two photodiodes 17, FIG. 4, each of which is adapted for emitting a pulsed beam of infrared light, not shown.

Spatially disposed in front of modelboard 11 is a marksman 23, schematically depicted as holding a simulated weapon 25, which the aforementioned marksman is aiming at target 13. Physically attached to the barrel of weapon 25 is a sensor element 27 adapted for receiving infrared light beam 19 whenever marksman 23 activates the trigger mechanism of weapon 25, so as to determine whether marksman 23 has scored a hit, a miss, or a near miss upon pop-up target 13. Similarly, sensor element 27 is adapted to receive the pulsed beam of infrared light emitted by the photodiodes 17, FIG. 4, of each linear motion target 15.

The output of sensor element 27 is connected to the data input of a rifle electronics circuit 28, the data output of which is connected to the data input of an interface circuit 29. The input-output terminal of interface circuit 29 is, in turn, connected to the input-output terminal of a microprocessor computer 31 which, in response to the sensing of infrared light beam 19 by sensor element 27, determines whether marksman 23 has scored a hit, a miss, or a near miss upon pop-up target 13.

At this time, it may be noteworthy to mention that the subject invention is adapted for utilization with the weapons training system described in U.S. patent application Ser. No. 105,313, entitled Electro-Optic Infantry Weapons Trainer by A. H. Marshall, B. F. Shaw, G. A. Siragusa, T. J. Riorden, and H. C. Towle. The aforementioned application fully describes in detail the operation of sensor element 27, rifle electronics circuit 28, interface circuit 29, microprocessor computer 31 and the interconnections therebetween. Accordingly, for the sake of keeping this disclosure as simple as possible, discussion of the above mentioned elements will be limited to their effect upon the operation of the subject invention.

The audio output of interface circuit 29 is connected to the input of a voice unit 33, the output of which is connected to the first input of an audio circuit 35, with the output thereof connected to the input of a headphone 37 adapted to be worn by marksman 23.

The target activate output of a microprocessor computer 39, which controls the sequencing of pop-up targets 13, and linear motion targets 15, is connected to the input of a modelboard interface circuit 41, the output of which is connected to the input of modelboard 11. In addition, the target present output of microprocessor computer 39 is connected to the target present input of interface circuit 29, and the audio output of microprocessor computer 39 is connected to the input of a bang circuit 43, the output of which is connected to the second input of audio circuit 35.

It may be mentioned at this time that voice unit 33 may be a computer voice system Model LVM-70 manufactured by Votrax of Troy, Mich., audio circuit 35 may be of the type described in the aforementioned U.S. patent application Ser. No. 105,313, and bang circuit 43 may be a sound generator Model SN76477N manufactured by Texas Instruments, Inc. of Dallas, Tex. In addition, microprocessor computer 31 may be a microprocessor computer Model 8748 manufactured by Intel, Inc. of Santa Clara, Calif.

Referring now to FIGS. *2a* through *2d*, there is shown an electrical schematic diagram of interface circuit 41 which includes a direct current voltage source 45, the output of which is connected to the input of a normally open switch 47, the input of a normally open switch 49, the input of a normally open switch 51 and the first input of a selector switch 53. The respective outputs of switches 47, 49, and 51 are, in turn, connected to the compatible sequence select inputs of microprocessor computer 39, the twelve target activate outputs of which are respectively connected to the first inputs of AND gates 55 through 77.

A ground 79 is connected to the second input of selector switch 53, the output of which is connected to the reset input of microprocessor computer 39. In addition, the output of selector switch 53 is connected to the second input of each AND gate 55 through 77 and the first input of a NAND gate 81.

The outputs of AND gates 55 through 77 are respectively connected to the first inputs of AND gates 83 through 105. The output of a signal generator 107 is connected to the second input of each AND gate 83 through 105.

The target present output of microprocessor computer 39 is connected to the target present input of interface circuit 29, the audio output of microprocessor computer 39 is connected to the input of bang circuit 43, and the ready output of microprocessor computer 39 is connected to the input of an inverter 109. The output of inverter 109 is, in turn, connected to the second input of NAND gate 81, the output of which is connected to the input of an inverter 11. Connected between the input and output of inverter 111 is direct current voltage source 45, and a pair of photodiodes 113 and 115.

Referring now to FIGS. *2a* and *2b*, there is shown a typical circuit which may be utilized to activate any one of the six pop-up targets 13 of FIG. 1. Accordingly, it should be noted that six circuits identical to that illustrated in FIG. *2b* will be required in the preferred embodiment of the subject invention.

Each of the circuits of FIG. *2b*, in turn, has an input terminal 116, with the aforementioned input terminals of the six circuits of FIG. *2b* respectively connected to the outputs of AND gates 55 through 65.

In addition, each of the six circuits of FIG. *2b* includes an inverter 117, the input of which is connected to input terminal 116, and the output of which is connected to the base of a PNP transistor 119. The emitter of transistor 119 is, in turn, connected to the output of a direct current voltage source 121, and the collector of transistor 119 is connected to the input of a drive coil 123, the output of which is connected to ground 79.

Referring now to FIGS. *2a* and *2c*, there is shown a typical circuit which may be utilized to activate any of the twelve photodiodes 17 mounted upon either pop targets 13, FIG. 1, or linear motion targets 15, FIG. 1. Accordingly, it should be noted that twelve circuits identical to that illustrated in FIG. *2c* will be required in the preferred embodiment of the subject invention. Each of the circuits of FIG. *2c*, in turn, has an input terminal 125, with the aforementioned input terminals of the twelve circuits of FIG. *2c* respectively connected to the outputs of AND gates 83 through 105.

In addition, each of the twelve circuits of FIG. *2c* includes an inverter 127, the input of which is connected to input terminal 125, and the output of which is connected to ground 79. The output of direct current voltage source 45 is connected to the input of photodiode 17, the output of which is connected to ground 79.

Referring now to FIGS. *2a* and *2d*, there is shown a typical circuit which may be utilized to drive any one of the three linear motion targets 15 of FIG. 1. Accordingly, it should be noted that three circuits identical to that illustrated in FIG. 2*d* will be required in the preferred embodiment of the subject invention. Each of the drive circuits of FIG. 2*d*, in turn, has a pair of input terminals 131 and 133, with the input terminals 131 of the three circuits of FIG. 2*d* respectively connected to the outputs of AND gates 67, 71, and 75, and the input terminals 133 of the three circuits of FIG. 2*d* respectively connected to the outputs of AND gates 69, 73, and 77.

Figure 2A:
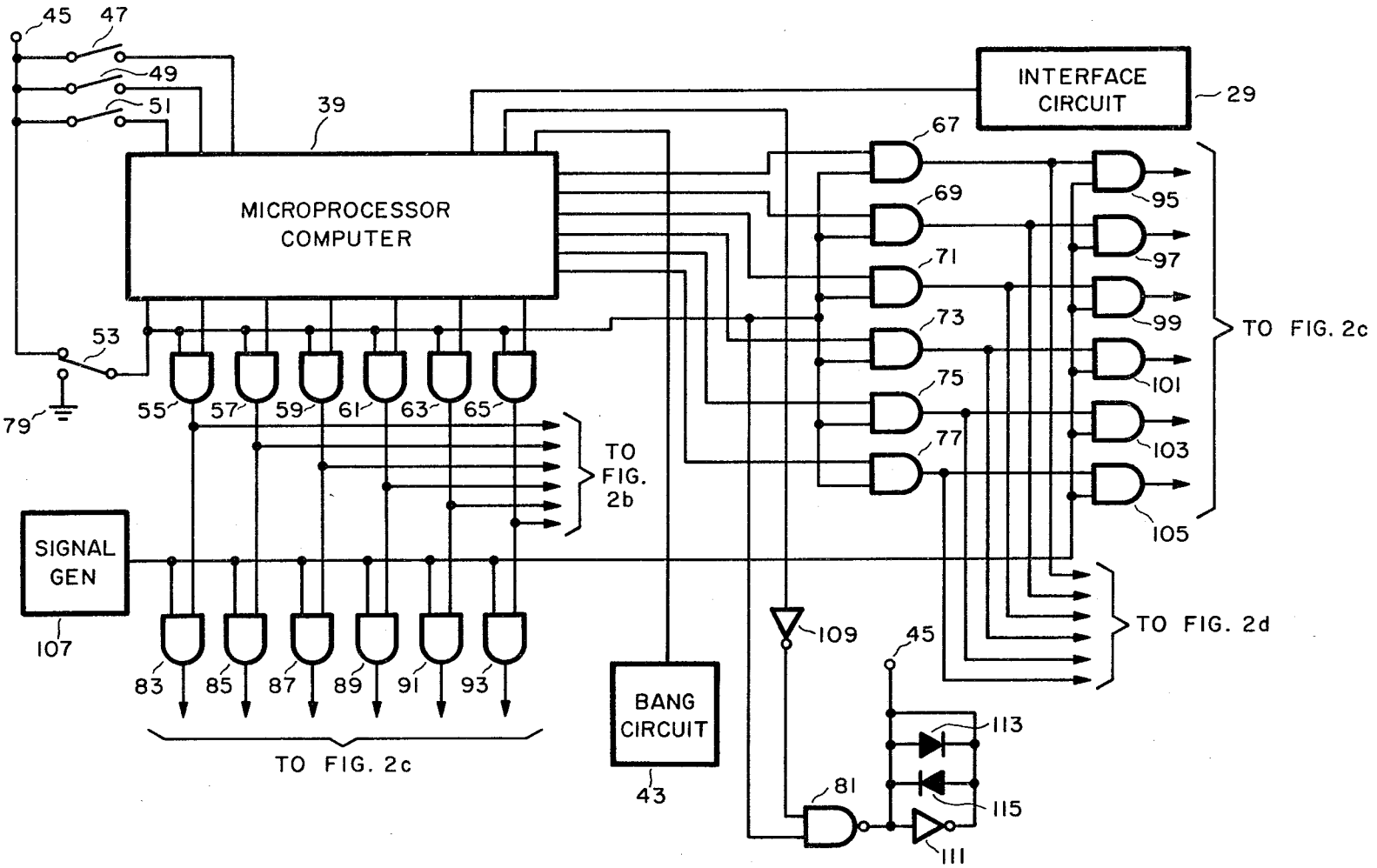
FIGS. 2*a*, 2*b*, 2*c*, and 2*d* show a circuit diagram of the modelboard interface circuit of FIG. 1.
Figure 2B:
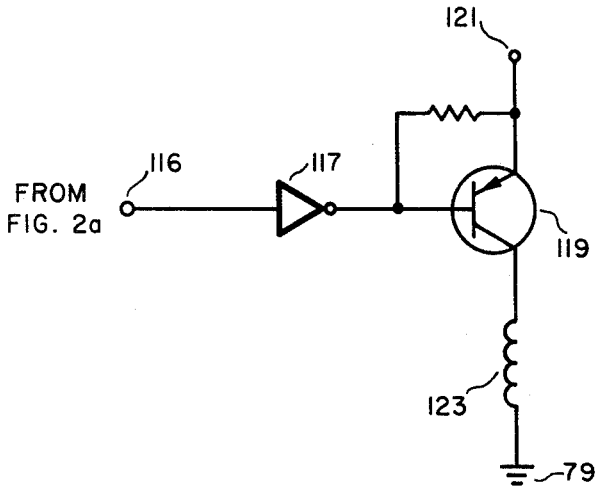
Figure 2C:
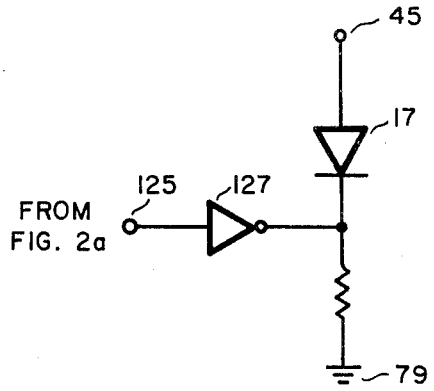
Figure 2D:
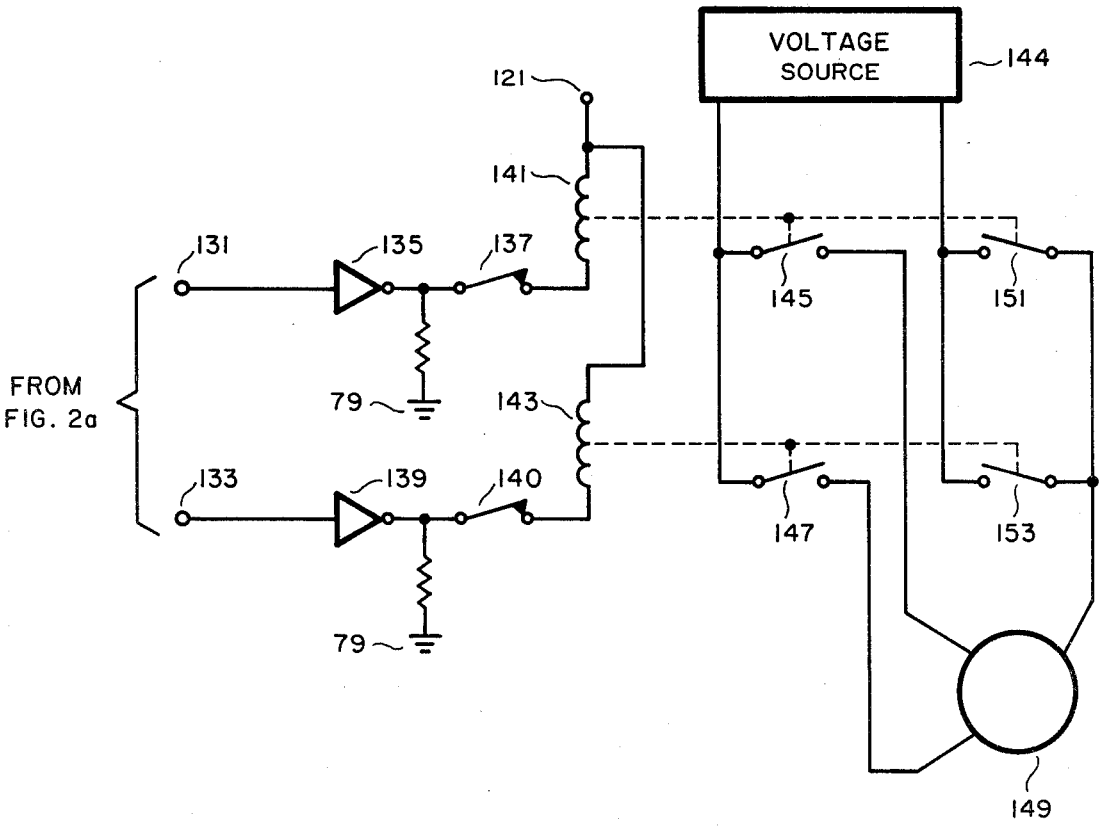

In addition, each of the circuits of FIG. 2*d* includes an inverter 135, the input of which is connected to input terminal 131, and the output of which is connected to ground 79, and the first terminal of a limit switch 137. Likewise, the input of an inverter 139 is connected to input terminal 133, and the output of inverter 139 is connected to ground 79 and the first terminal of a limit switch 140. The output of direct current voltage source 121 is connected to the input of a relay solenoid 141, the output of which is connected to the second terminal of limit switch 137. In addition, the output of direct current voltage source 121 is connected to the input of a relay solenoid 143, the output of which is connected to the second terminal of limit switch 140.

The line terminal of an alternating current voltage source 144 is connected to the input of a relay switch 145, and the input of a relay switch 147. The output of relay switch 145 is connected to the first terminal of a reversible drive motor 149. The output of relay switch 147 is connected to the second terminal of drive motor 149, the third terminal of which is connected to the input of a relay switch 151, and the input of a relay switch 153. The output of relay switch 151 and the output of relay switch 153 are, in turn, connected to the neutral terminal of alternating current voltage source 144.

The mechanical actuation output of relay solenoid 141 is connected to the mechanical actuation input of relay switch 145, and the mechanical actuation input of relay switch 151. Likewise, the mechanical actuation output of relay solenoid 143 is connected to the mechanical actuation input of relay switch 147, and the mechanical actuation input of relay switch 153.

Figure 3:
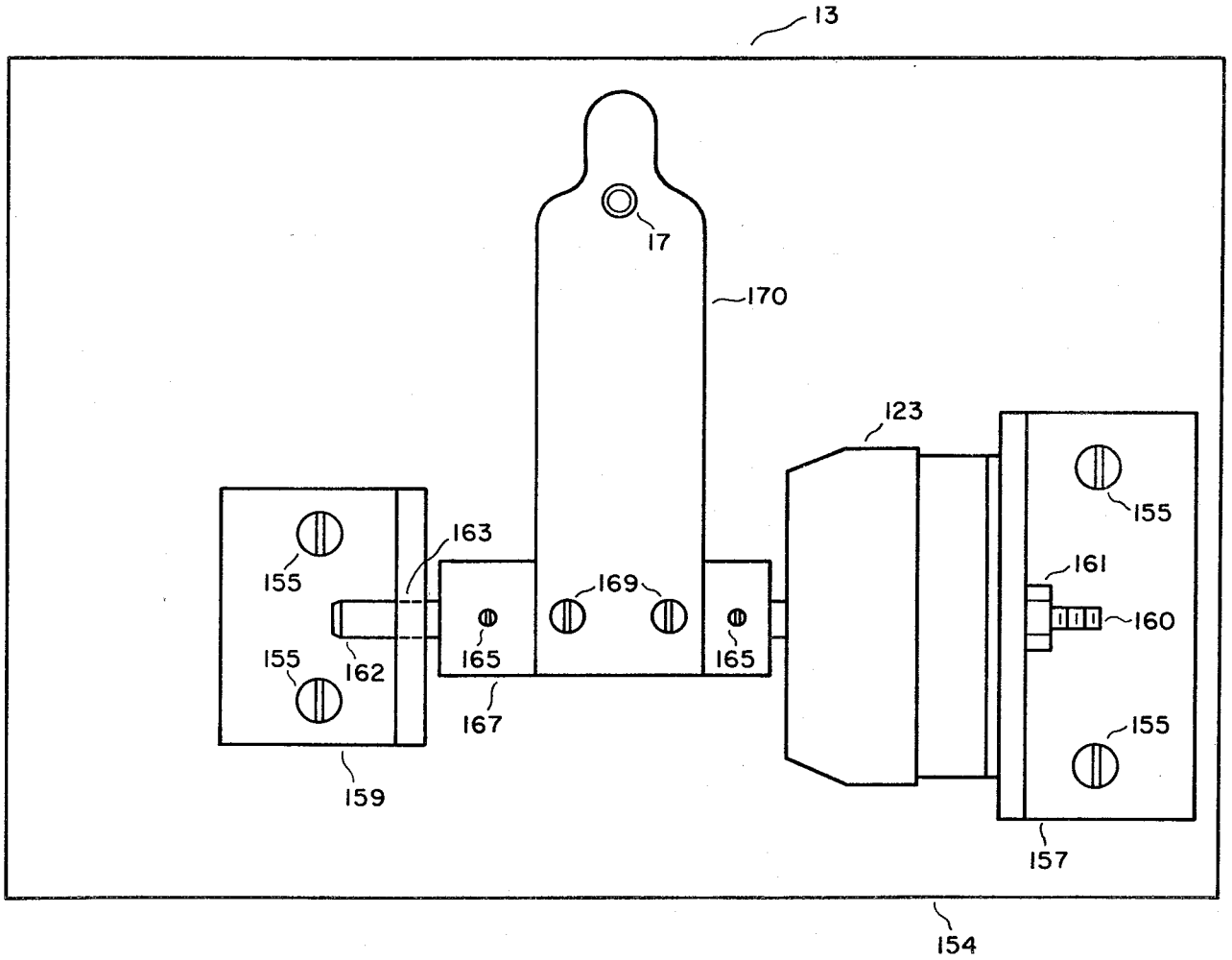
FIG. 3 is a schematic diagram of a pop-up target of FIG. 1.

Referring now to FIGS. 1 and 3, there is shown one of six pop-up targets 13 comprising a base which is mounted within modelboard 11. Mounted upon base 154, as by a plurality of machine screws 155, are a pair of L-shaped support brackets 157 and 159. Mounted upon support bracket 157 and secured thereto by a bolt 160 and nut 161 is coil 123. Coil 123 has a shaft 162 which passes through an aperture 163 located within support bracket 159. Mounted upon shaft 162 of coil 123 and secured thereto by a pair of set screws 164 is a target support block 167. Fixedly attached to support block 167 as by a pair of machine screws 169 is a target 170.

As will be discussed more fully below, whenever coil 123 is activated, shaft 162 of coil 123 will rotate such that target 170 will pass or pop-up through an aperture within the terrain surface of modelboard 11.

Figure 4:
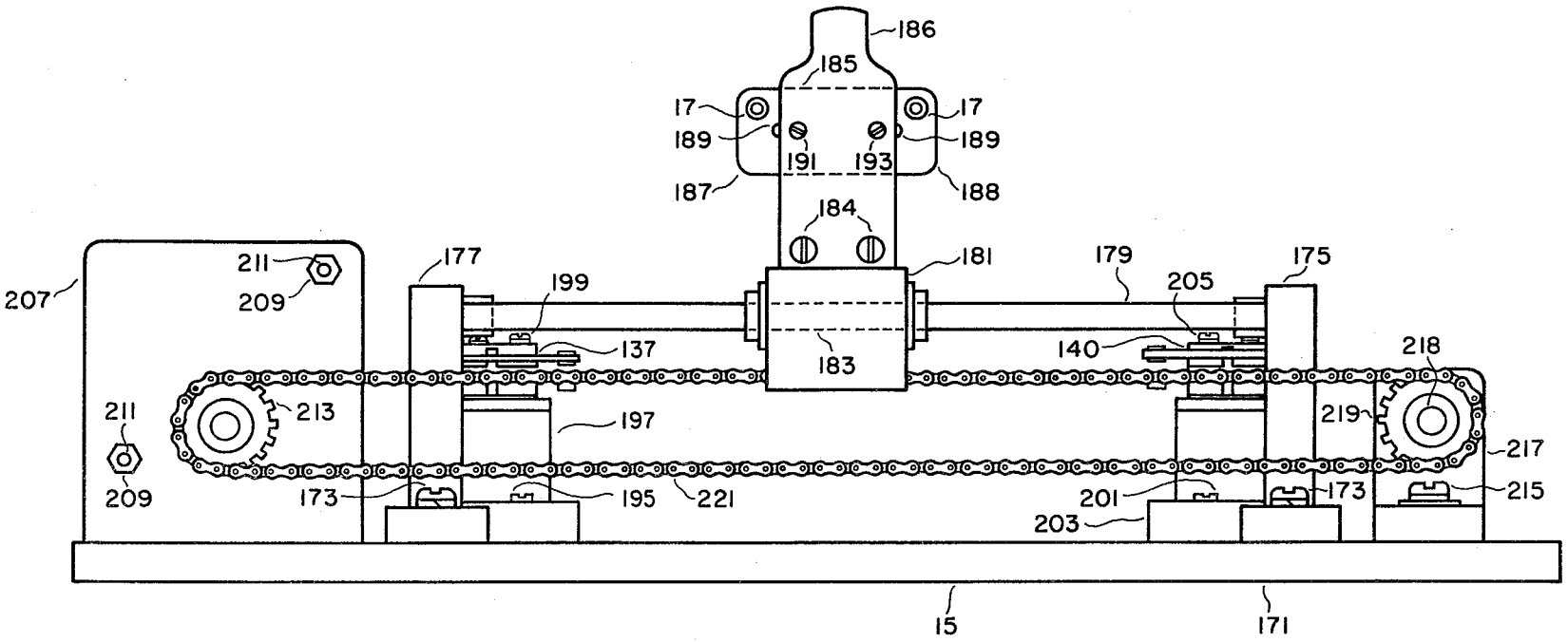
FIG. 4 is a schematic diagram of a linear motion target of FIG. 1.

Referring now to FIGS. 1 and 4, there is shown one of three linear motion targets 15 comprising a base 171 which is mounted wihin modelboard 11. Mounted upon base 171, as by a plurality of machine screws 173, are a pair of oppositely disposed guide rod support brackets 175, and 177. Rigidly mounted between guide rod 175 and guide rod 177 are a pair of parallel guide rods 179 which constitute a track or guide way for a target support block 181. Target support block 181 has therein a pair of apertures 183, each of which has passing therethrough one of the pair of guide rods 179.

Fixedly attached to target support block 181, as by a pair of machine screws 184 and passing through a slot located within modelboard 11 is a target 186 which has on the backside thereof a recess 185. Recess 185 of target 186 has adjustably mounted therein a pair of rectangular shaped arms 187 and 188, each of which has a channel 189 therein.

A locking screw 191, which passes through channel 189 of arm 187, locks arm 187 in a fixed position with respect to target 186. Likewise, a locking screw 193, which passes through channel 189 of arm 188, locks arm 188 in a fixed position with respect to target 186. In addition, each arm of target 15 has mounted therein one of the pair of photodiodes 17 incorporated within target 15.

At this time, it should be noted that each arm of linear motion target 15 is adjustable so as to allow for proper lead when training with weapon 25.

Mounted upon base 171 adjacent support bracket 177, as by a plurality of machine screws 195, is a limit switch support block 197. Support block 197, in turn, has mounted thereon, as by a plurality of machine screws 199, limit switch 137.

Mounted upon base 171 adjacent support bracket 175, as by a plurality of machine screws 201, is a limit switch support block 203. Support block 203, in turn, has mounted thereon, as by a plurality of machine screws 205, limit switch 140.

Mounted upon one end of base 171 adjacent support bracket 177, as by a plurality of machine screws, not shown, is a motor support bracket 207. Motor support bracket 207 has mounted thereto, as by a pair of nuts 209 and bolts 211, motor 149, FIG. 2*d*, the shaft of which passes through an aperture, not shown, within bracket 207. Connected to the shaft of motor 149, FIG. 2*d*, is a sprocket 213.

Mounted upon the opposite end of base 171 adjacent support bracket 175 as by a plurality of machine screws 215 is a sprocket support bracket 217. Passing through an aperture, not shown, within sprocket support bracket 217 is a sprocket support shaft 218, one end of which has connected thereto a sprocket 219 and the opposite end of which has connected thereto a collar, not shown. Meshing with the teeth of sprocket 213, and the teeth of sprocket 219 is a drive chain 221, one end of which is connected to one side of support block 181 by a first locking pin, not shown, and the opposite end of which is connected to the opposite side of support block 181 by a second locking pin, not shown.

As will be discussed more fully below, activation of motor 149, FIG. 2*d*, so as to cause the rotation thereof in a clockwise direction will move target 15 to the right along parallel guide rods 179. Likewise, activation of motor 149, FIG. 2*d*, so as to cause the rotation thereof in a counterclockwise direction will move target 15 to the left along parallel guide rods 179.

Figure 5A:
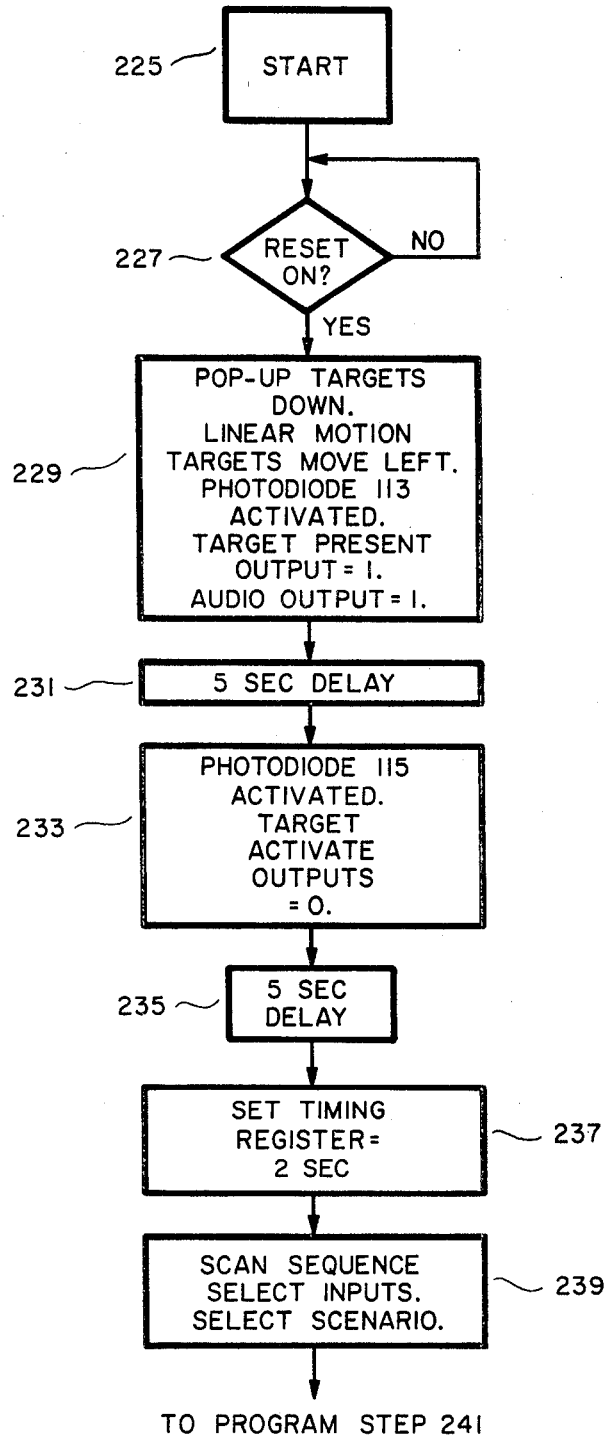
FIGS. 5*a* and 5*b* is a flow chart of the computer program utilized by the microprocessor computer which controls the sequencing of the targets of FIG. 1.
Figure 5B:
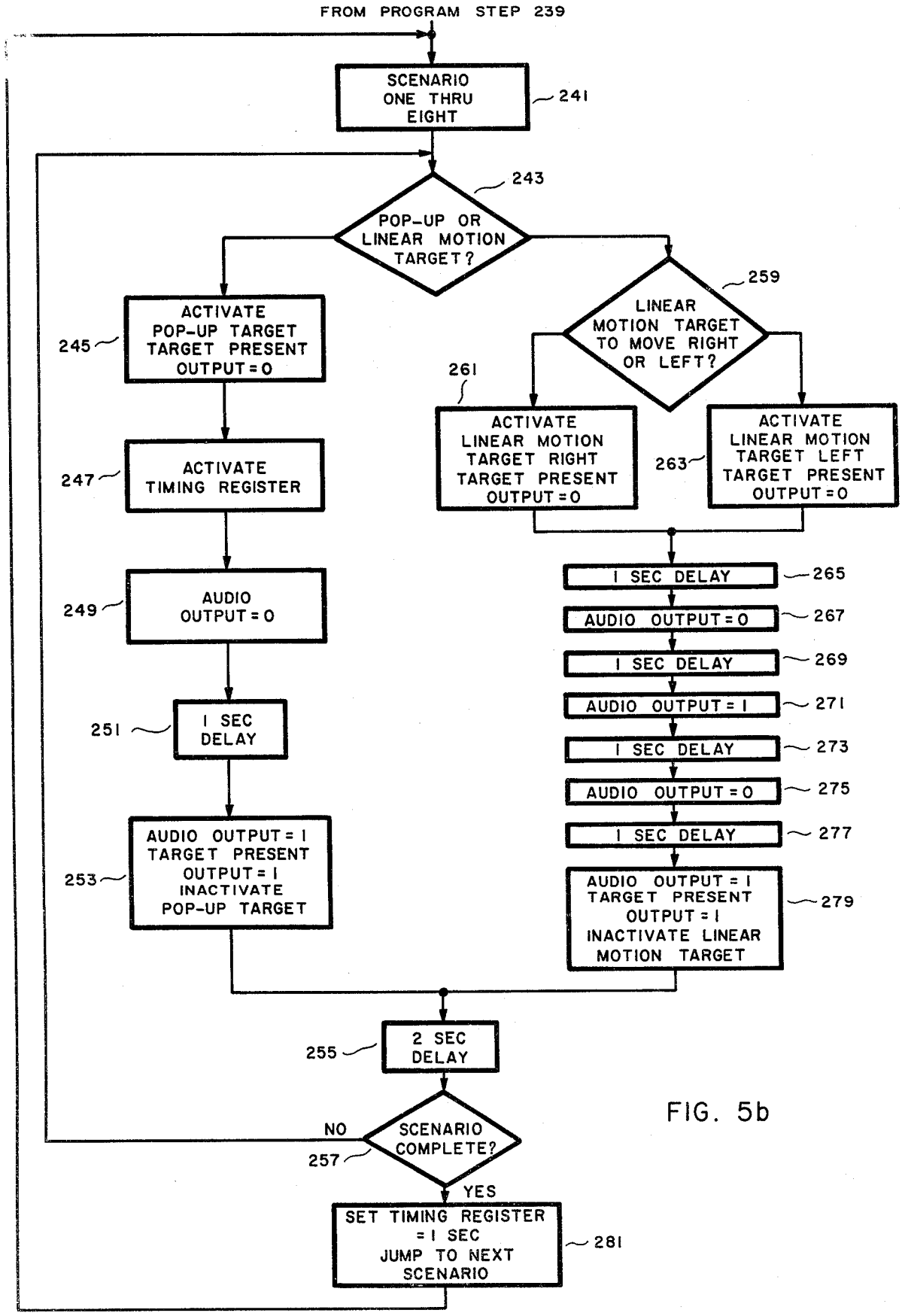

Referring now to FIGS. 1, 5*a* and 5*b*, there is shown a flow chart of a computer program utilized by microprocessor computer 39 to control the sequencing of the pop-up targets 13 and linear motion targets 15 of the subject invention. The details of the aforementioned computer program will be discussed more fully below.

The operation of the subject invention will now be discussed in conjunction with all of the figures of the drawing, and with reference to the program steps of the computer program of FIG. 5.

Referring now to FIGS. 1 through 5, program step 225 starts the computer program utilized by microprocessor computer 39. Program step 227 determines whether the reset input of microprocessor computer 39 is in a logic "1" state or a logic "0" state. When switch 53 is positioned such that there is a current path from direct current voltage source 45 through switch 53, a logic "1" signal will appear at the reset input of microprocessor computer 39, and the second inputs of AND gates 55 through 77. This, in turn, causes the computer program utilized by microprocessor computer 39 to proceed to program step 229. In addition, digital logic signals which appear at the target select outputs of microprocessor computer 39 may now pass through AND gates 55 through 77 so as to activate pop-up targets 13, and linear motion targets as will be discussed more fully below.

Program step 229 causes microprocessor computer 39 to supply to the first input of AND gate 67, a logic "1" signal which, in turn, passes through AND gate 67 to the input of inverter 135. The output of inverter 135 will then change from a logic "1" state to a logic "0" state, thereby allowing a direct current provided by direct current voltage source 121 to pass through solenoid coil 141 and limit switch 137 to ground 79. This, in turn, energizes coil 141 so as to close relay switches 145 and 151. An alternating current signal provided by alternating current voltage source 144 will then energize motor 149 so as to rotate the shaft thereof in a counterclockwise direction, thereby moving target 15 to the left. Target 15 will continue to move left until support block 181 makes contact with limit switch 137, thereby opening limit switch 137 which de-energizes motor 149.

Likewise, microprocessor computer 39 will supply to the first input of AND gate 71 and the first input of AND gate 75 a logic "1" signal so as to cause the outputs of the aforementioned AND gates to change from a logic "0" state to a logic "1" state. This, in turn, moves the remainder of the linear motion targets 15 of the subject invention to the left in the manner described above.

During program step 229, the remaining target activate outputs will be in the logic "0" state. This, in turn, inactivates each of the six pop-up targets 13 of the subject invention to the down position, as will be discussed more fully below. In addition, during program step 229, the ready output of microprocessor computer 39 is set to a logic "1" state. The output of inverter 109 will then change from a logic "1" state to a logic "0" state, the output of NAND gate 81 will change from a logic "0" state to a logic "1" state, and the output of inverter 111 will change from a logic "1" state to a logic "0" state. This then allows the direct current provided direct current voltage source 45 to pass through photodiode 113 so as to activate photodiode 113. Photodiode 113 will then emit therefrom a red light which indicates to marksman 23 that targets 13 and 15 are not present upon modelboard 11. The target present output and the audio output of microprocessor computer 39 are each set to a logic "1" state during program step 229, as will be discussed more fully below.

Program step 231 is an internal five second delay within the computer program utilized by microprocessor computer 39.

During program step 233 the ready output of microprocessor computer 39 changes from an active "1" state to an inactive "0" state. This, in turn, activates photodiode 115 which emits therefrom a green light so as to indicate to marksman 23 that targets 13 and 15 will appear upon modelboard 11. In addition, during program step 233 AND gates 67, 71, and 75, and the compatible target activate outputs of microprocessor computer 39 change from an active "1" state to an inactive "0" state.

Program step 235 is an internal five second delay within the computer program utilized by microprocessor computer 39.

Program step 237 initially sets an internal timing register, not shown, within microprocessor computer 39 to a time delay of two seconds. This, in turn, controls the pop-up time of each of the six pop-up targets 13 of the subject invention, as will be discussed more fully below.

During program step 239, microprocessor computer 39 scans the sequence select inputs thereof so as to decode the aforementioned sequence select inputs, and thereby determine which one of eight scenarios or subprograms will be utilized by microprocessor computer 39 to control the sequencing of the six pop-up targets 13 and the three linear motion targets 15 of the subject invention. Thus, for example, if only swich 47 is in the closed position such that the direct current provided by direct current voltage source 45 will pass therethrough, then microprocessor computer 39 will select, in accordance with the truth table of FIG. 6, the second of eight subprograms of the program utilized by microprocessor computer 39 to control the sequencing of targets 13 and 15.

Program step 241 causes microprocessor computer 39 to start the subprogram decoded thereby in program step 239. In addition, whenever any one of the eight subprograms of the computer program utilized by microprocessor computer 39 is complete, microprocessor computer 39 will continue in sequence, during program step 241, to the next subprogram of the program utilized thereby.

Program step 243 determines whether a pop-up target 13 or a linear motion target 15 should be activated by microprocessor computer 39 in accordance with the subprogram of FIG. 6 selected in program step 239.

Program step 245 activates one of the six pop-up targets 13 of the subject invention. Thus, for example, if the particular subprogram being utilized by microprocessor computer 39 indicates that the pop-up target 13 which is compatible with AND gate 55 is to be activated, microprocessor computer 39 will supply to the first input of AND gate 55 a logic "1" signal. AND gate 55 will then change from a logic "0" state to a logic "1" state, thereby causing the output of inverter 117 to change from a logic "1" state to a logic "0" state. This, in turn, allows the direct current provided by direct current voltage source 121 to pass through transistor 119 and coil 123 to ground 79 so as to energize coil 123, thus causing pop-up target 13 to appear upon the terrain surface of modelboard 11.

In addition, the logic "1" signal which appears at the output of AND gate 55 is supplied to the second input of AND gate 83 so as to allow a ninety-six hertz clock signal provided by signal generator 107 to pass through AND gate 83 to the input of inverter 127, which inverts the aforementioned clock signal. Whenever the output of inverter 127 is in a logic "0" state, the direct current provided by direct current voltage source 45 will pass through photodiode 17 so as to energize photodiode 17. This, in turn, results in pulsed infrared light beam 19 being emitted from pop-up target 13 by photodiode 17.

When pop-up target 13 appears upon modelboard 11, marksmen 23 may aim and fire weapon 25 at target 13. Sensor 27 will then sense infrared light beam 19 and provide at the output thereof an analog signal proportional to the amount of infrared light received thereby. The aforementioned analog signal will then pass through rifle electronics circuit 28, which converts the analog signal to a digital logic signal. The aforementioned digital logic signal, in turn, passes through interface circuit 29 to microprocessor computer 31.

Whenever pop-up target 13 appears upon modelboard 11, the target present output of microprocessor computer 39 will change from a logic "1" state to a logic "0" state so as to provide a target present signal which passes through interface circuit 29 to microprocessor computer 31. Microprocessor computer 31 will then determine, in accordance with a computer program utilized thereby, whether marksman 23 has scored a hit, a miss, or a near miss upon pop-up target 13.

Microprocessor computer 31 will supply through interface circuit 29 to voice unit 33 a logic signal indicative of whether marksman 23 has scored a hit, a miss, or a near miss upon pop-up target 13. The aforementioned logic signal is then converted to an audio signal by voice unit 33 and supplied through audio circuit 35 to the input of headphone 37. Headphone 37, in turn, converts the aforementioned audio signal to an audio message, which indicates to marksman 23 whether a hit, a miss, or a near miss has been scored upon pop-up target 13.

As mentioned above, the operation of sensor element 27, rifle electronics circuit 28, interface circuit 29, microprocessor computer 31, and the interconnections therebetween is fully discussed in U.S. patent application Ser. No. 105,313.

Program step 247 activates the timing register within microprocessor computer 39, such that the logic "1" signal supplied to the first input of AND gate 55 will remain in the active "1" state for a time period of two seconds, thereby allowing pop-up target 13 to remain visible to marksman 23 for two seconds.

Program step 249 causes the audio output of microprocessor computer 39 to change from a logic "1" state to a logic "0" state so as to activate bang circuit 43. Bang circuit 43, in turn, supplies an audio signal through audio circuit 35 to the input of headphone 37. Headphone 37 then converts the aformentioned audio signal to an audio message simulating a rifle shot so as to indicate to marksman 23 that a pop-up target 13 is present upon modelboard 11.

Program step 251 is a one-second delay within the computer program utilized by microprocessor computer 39 which will cause pop-up target 13 to remain visible to marksman 23 for an additional one-second time period. Thus, during the initial subprogram of the computer program utilized by microprocessor computer 39, each pop-up target 13 will remain visible to marksman 23 for a time period of three seconds.

During program step 253, microprocessor computer 39 inactivates pop-up target 13 by supply to the first input of AND gate 55 a logic "0" signal so as to change the output of AND gate 55 from a logic "1" state to a logic "0" state. This, in turn, de-energizes coil 123, thereby causing pop-up target 13 to disappear from the terrain surface of modelboard 11. In addition, during program step 253 the audio output and the target present output of microprocessor computer 39 each change from a logic "0" state to a logic "1" state.

Program state 255 is an internal two-second delay within the program utilized by microprocessor computer 39.

Program step 257 determines whether the subprogram initialized in step 241 by microprocessor computer 39 is complete.

Program step 259 selects one of the three linear motion targets 15 to be activated by microprocessor computer 39, and determines whether the aforementioned linear motion target 15 will move right or left upon the terrain surface of modelboard 11.

Program step 261 activates the linear motion target 15 selected in program step 259 such that linear motion target 15 will move in a direction to the right upon the terrain surface of modelboard 11. Thus, for example, if the particular subprogram being utilized by microprocessor computer 39 indicates that the linear motion target 15 which is compatible with AND gate 69 is to be activated, microprocessor computer 39 will supply to the first input of AND gate 69 a logic "1" signal, which passes through AND gate 69 to the input of inverter 139. The output of inverter 139 will then change from a logic "1" state to a logic "0" state, thereby allowing the direct current provided by direct current voltage source 121 to pass through solenoid coil 143 and limit switch 137 to ground 79. This, in turn, energizes coil 143 so as to close relay switches 147 and 153. The alternating current signal provided by alternating current voltage source 144 will then energize motor 149 so as to rotate the shaft thereof in a clockwise direction, thereby moving target 15 to the right. Simultaneously, the logic "1" signal which appears at the output of AND gate 69 is supplied to the second input of AND gate 97 so as to allow the ninety-six hertz clock signal provided by signal generator 107 to pass through AND gate 97 to the input of inverter 127, which inverts the aforementioned clock signal. This, in turn, results in a pulsed infrared light beam being emitted from linear motion target 15 by photodiode 17 located upon arm 188 of linear motion target 15.

When linear motion target 15 becomes visible to marksman 23, he may aim and fire weapon 25 at target 15. As discussed previously, arm 188 of linear motion target 15 may be adjusted so as to allow for proper lead when training with weapon 25. Thus, to score a hit upon target 15, marksman 23 must aim weapon 25 to the right of the center point of linear motion target 15.

During program step 261, the target present output of microprocessor computer 39 changes from a logic "1" state to a logic "0" state so as to provide a target present signal through interface circuit 29 to microprocessor computer 31. This, in turn, allows microprocessor computer 31 to determine, in accordance with the computer program utilized thereby, whether marksman 23 has scored a hit, a miss, or a near miss upon linear motion target 15.

Linear motion target 15 will continue to move right upon the terrain surface of modelboard 11 for a time period of four seconds until support block 181 of target 15 makes contact with limit switch 140. This, in turn, opens limit switch 140 so as to de-energize motor 149 of linear motion target 15. Program steps 265, 269, 273, and 277 provide an internal four-second delay within the computer program utilized by microprocessor computer 39, such that the outputs of AND gates 69 and 97 will remain in a logic "1" state while linear motion target 15 moves across the terrain surface of modelboard 11. Thus, marksman 23 has for seconds to engage linear motion target 15 and score a hit thereon.

Program step 267 activates bang circuit 43 such that marksman 23 will sense through headphone 37 a first rifle shot. Program shot 271 then inactivates bang circuit 43 after the one-second delay provided by program step 269. After step 275 will reactivate bang circuit 43 such that marksman 23 will sense through headphone 37 a second rifle shot. The aforementioned first and second rifle shots, in turn, indicate to marksman 23 that a linear motion target 15 is moving either right or left upon the terrain surface of modelboard 11.

During program step 279 microprocessor computer 39 inactivates linear motion target 15 by supplying to the first input of AND gate 69 a logic "0" signal so as to change the output thereof from a logic "1" state to a logic "0" state. This, in turn, causes the output of AND gate 97 to change from a logic "1" state to a logic "0" state so as to inactivate the pulsed infrared light beam being emitted by photodiode 17 mounted upon arm 188 of linear motion target 15. In addition, during program step 279, the audio output and the target present output of microprocessor computer 39 each change from a logic "0" state to a logic "1" state.

Program step 263 operates in exactly the same manner as program step 261 except that linear motion target 15 moves left, and photodiode 17 mounted upon arm 187 of target 15 emits therefrom a pulsed beam of infrared light. Hence, for the sake of keeping this disclosure as simple as possible, the details of the operation of program step 263 will not be described.

When the initial subprogram of the computer program utilized by microprocessor computer 39 is complete, the timing register within microprocessor computer 39 will be reset, during program step 281, from a time delay of two seconds to a time delay of one second. This, in turn, results in each pop-up target 15 remaining visible to marksman 23 for a time period of two seconds.

At this time it may be noteworthy to mention that the computer program utilized by microprocessor computer 39 may be reinitialized by positioning switch 53 such that there is a current path from ground 79 to the reset input of microprocessor computer 39, and then positioning switch 53 such that there is a current path from direct current voltage source 45 to the reset input of microprocessor computer 39. Thus, for example, if it is desired to switch from subprogram two of FIG. 6 to subprogram seven of FIG. 6, an instructor, not shown, may position switch 53 such that there is a current path from ground to the reset input of microprocessor computer 39, close switches 51 and 49, and then position switch 53 such that there is a current path from voltage source 45 to the reset input of microprocessor computer 39. This, in turn, allows the instructor, not shown, to vary the sequence in which targets 13 and 15 are to appear upon the terrain surface of modelboard 11 so that marksman 23 cannot familiarize himself with the order of appearance of targets 13 and 15 upon modelboard 11.

From the foregoing, it may readily be seen that the subject invention comprises a new, unique, and exceedingly useful linear motion and pop-up target training system which constitutes a considerable improvement over the known prior art. Obviously, many modifications and variations of the present invention are possible in light of the above teachings. It is, therefore, to be understood that within the scope of the appended claims the invention may be practiced otherwise than as specifically described.

What is claimed is:

1. A weapons training system comprising, in combination:

a modelboard having a terrain surface thereon, said terrain surface having a plurality of apertures, and a plurality of slots located therein;

a plurality of pop-up targets, each of which has first and second inputs, each of which, when activated, pops up through one of the apertures located in the terrain surface of said modelboard, and each of which, when activated, emits therefrom a pulsed beam of infrared light;

a plurality of linear motion targets, each of which has first, second, third, and fourth inputs, each of which, when activated, moves in either a first predetermined direction, or a second predetermined direction upon the terrain surface of said modelboard, and each of which, when activated, emits therefrom a pulsed beam of infrared light;

first computing means having a reset input, first, second, and third sequence select inputs, a plurality of target activate outputs, a target present output, and an audio output for providing digital logic signals at the target activate outputs thereof so as to effect the activation of each of said linear motion targets and said pop-up targets in a predetermined sequence in accordance with a computer program utilized thereby, for providing a target present signal at the target present output thereof whenever one of said linear motion targets, or one of said pop-up targets is activated thereby, and for providing a movement indicator signal at the audio output thereof whenever one of said linear motion targets or one of said pop-up targets is activated thereby;

first signal generating means having an output for providing at the output thereof a direct current voltage signal;

switching means having a first input connected to the output of said first signal generating means, a second input connected to ground and an output connected to the reset input of said first computing means for passing therethrough the direct current voltage signal provided by said signal generating means so as to initialize the computer program utilized by said first computing means;

first gating means having a plurality of inputs, with the first input thereof connected to the output of said switching means, and the remaining inputs thereof respectively connected to the target activate outputs of said first computing means, a plurality of pop-up target activation outputs respectively connected to the first inputs of said pop-up targets, and a plurality of linear motion target activation outputs, one half of which are respectively connected to the first inputs of said linear motion targets, and the other half of which are respectively connected to the second inputs of said linear motion targets adapted for passing therethrough the digital logic signals provided by said first computing means only when said switching means is positioned such that the direct current voltage signal provided by said first signal generating means passes through said switching means to the first input thereof;

second signal generating means having an output for providing at the output thereof a clock signal having a predetermined frequency;

second gating means having a clock input connected to the output of said second signal generating means, a plurality of pop-up target activation inputs respectively connected to the pop-up target activation outputs of said first gating means, a plurality of linear motion target activation inputs respectively connected to the linear motion target activation outputs of said first gating means, a plurality of pop-up target light beam activation outputs respectively connected to the second inputs of said pop-up targets, and a plurality of linear motion target light beam target activation outputs, one half of which are respectively connected to the third inputs of said linear motion targets, and the other half of which are respectively connected to the fourth inputs of said linear motion targets adapted for passing therethrough, in response to the digital logic signals provided by said first computing means, the clock signal provided by said second signal generating means so as to effect the activation of the pulsed beam of infrared light emitted from the linear motion or pop-up target activated by said first computing means;

an imitation weapon having a trigger mechanism for effecting the simulated firing thereof;

sensing means mounted upon the barrel of said weapon, and having an output for receiving the pulsed beam of infrared light from the linear motion or pop-up target activated by said first computing means, and for providing at the output thereof an analog signal proportional to the amount of infrared light received thereby; and second computing means having a data input connected to the output of said sensing means, a target present input connected to the target present output of said first computing means, and an audio output for converting the analog signal provided by said sensing means to a digital logic signal, and for processing, in accordance with a predetermined computer program, the digital logic signal converted thereby, and the target present signal provided by said first computing means so as to generate a logic indicator signal indicative of whether said marksman has scored a hit, a miss, or a near miss upon the linear motion or pop-up target activated by said first computing means.

2. The weapons training system of claim 1 wherein each of said pop-up targets comprises:

a base mounted within said modelboard;

a pair of L shaped support brackets, the first of which is mounted upon one end of said base, and the second of which is mounted upon the opposite end of said base;

an aperture located within the first of said pair of L shaped support brackets;

a coil mounted upon the second of said pair of L shaped support brackets, said coil having an input effectively connected to one of the pop-up target activation outputs of said first gating means, and a shaft rotatably extending through the aperture of the first of said pair of support brackets;

a support block mounted upon the shaft of said coil;

a target fixedly attached to said support block; and a photodiode mounted upon said target, said photodiode having an input connected to one of the pop-up target light beam activation outputs of said second gating means.

3. The weapons training system of claim 1 wherein each of said linear motion targets comprises:

a base mounted within said modelboard;

a pair of guide rod support blocks mounted upon said base, the first of which is located near one end of said base, and the second of which is located near the opposite end of said base;

a pair of parallel guide rods rigidly mounted between said pair of guide rod support blocks;

a target support block having therein a pair of apertures, each of which has passing therethrough one of said pair of guide rods;

a pair of limit switch support blocks, the first of which is mounted upon said base adjacent to the first of said pair of guide rod support blocks, and the second of which is mounted upon said base adjacent the second of said pair of guide rod support blocks;

a first limit switch mounted upon the first of said pair of limit switch support blocks, said first limit switch having an input connected to one of the linear motion target activation outputs of said first gating means, and an output;

a second limit switch mounted upon the second of said pair of limit switch support blocks, said second limit switch having an input connected to another of the linear motion target activation outputs of said first gating means, and an output;

a motor support bracket mounted upon one end of said base adjacent the first of said pair of guide rod support blocks, said motor support bracket having therein an aperture;

a motor mounted upon said motor support bracket, said motor having a shaft passing through the aperture of said motor support bracket, a first input connected to the output of said first limit switch, and a second input connected to the output of said second limit switch;

a first sprocket connected to the shaft of said motor, said first sprocket having a plurality of teeth;

a sprocket support bracket mounted upon the opposite end of said base adjacent the second of said pair of guide rod support blocks, said sprocket support bracket having therein an aperture;

a sprocket support shaft passing through the aperture of said sprocket support bracket;

a second sprocket connected to one end of said sprocket support shaft, said second sprocket having a plurality of teeth;

a collar connected to the opposite end of said sprocket support shaft;

a drive chain having one end thereof connected to one side of said target support block, the opposite end thereof connected to the opposite side of said target support, and the remainder thereof meshing with the teeth of said first sprocket and the teeth of said second sprocket;

a target fixedly attached to said target support block and passing through one of the slots located within the terrain surface of said modelboard, said target having a recess therein;

a pair of rectangular-shaped arms adjustably mounted within the recess of said target;

a first photodiode mounted upon the first of said pair of rectangular-shaped arms, said first photodiode having an input connected to one of the linear motion light beam activation outputs of said second gating means; and a second photodiode mounted upon the second of said pair of rectangular-shaped arms, said second photodiode having an input connected to another of the linear motion light beam activation outputs of said second gating means.

4. The weapons training system of claim 1 wherein said first gating means comprises a plurality of two input AND gates, each of which has the first input thereof connected to one of the target activate outputs of said first computing means, and each of which has the second input thereof connected to the output of said switching means.

5. The weapons training system of claim 1 where said second gating means comprises a plurality of two input AND gates, one half of which have the first inputs thereof respectively connected to the pop-up target activation outputs of said first gating means, the other half of which have the first inputs thereof respectively connected to the linear motion target activation outputs of said first gating means, and each of which has the second input thereof connected to the output of said second signal generating means.

6. The weapons training system of claim 1, wherein said imitation weapon comprises a rifle.

7. The weapons training system of claim 1, wherein said second computing means comprises:

a rifle electronics circuit having an input connected to the output of said sensing means, and an output;

an interface circuit having a target present input connected to the target present output of said first computing means, a data input connected to the output of said rifle electronics circuit, and an input-output terminal; and a microprocessor computer having an input-output terminal connected to the input-output terminal of said interface circuit.

8. The weapons training system of claim 1, further characterized by:

a bang circuit having an input connected to the audio output of said first computing means, and an output for providing an audio signal at the output thereof in response to the movement indicator signal provided by said first computing means;

a voice unit having an input connected to the audio output of said second computing means, and an output for providing an audio signal at the output thereof in response to the hit indicator signal generated by said second computing means;

an audio circuit having a pair of inputs, the first of which is connected to the output of said voice unit, and the second of which is connected to the output of said bang circuit for passing therethrough the audio signal provided by said bank circuit, and the audio signal provided by said voice unit; and a headphone adapted to be worn upon the head of said marksman, and having an input connected to the output of said audio circuit for converting the audio signal provided by said bang circuit to an audio message simulating a rifle shot so as to indicate to said marksman that either a pop-up target or a linear motion target has been activated by said first computing means, and for converting the audio signal provided by said voice unit to an audio message so as to indicate to said marksman whether a hit, a miss, or a near miss has been scored upon the linear motion or pop-up target activated by said first computing means.

9. The weapons training system of claim 1, further characterized by:

a first normally open switch having an input connected to the output of said first signal generating means, and an output connected to the first sequence select input of said first computing means;

a second normally open switch having an input connected to the output of said first signal generating means, and an output connected to the second sequence select input of said first computing means; and a third normally open switch having an input connected to the output of said first signal generating means, and an output connected to the third sequence select input of said first computing means.

10. A target training system comprising, in combination:

a model board having a terrain surface thereon, said terrain surface having a sextet of apertures, and a trio of slots located therein;

first, second, third, fourth, fifth, and sixth pop-up targets, each of which has first and second inputs, each of which, when activated, pops up through one of the sextet of apertures located in the terrain surface of said modelboard, and each of which, when activated, emits therefrom a pulsed beam of infrared light;

first, second, and third linear motion targets, each of which has first, second, third, and fourth inputs, each of which, when activated, moves in either a first predetermined direction, or a second predetermined direction upon the terrain surface of said modelboard, and each of which, when activated, emits therefrom a pulsed beam of infrared light;

a first microprocessor computer having a reset input, first, second, and third sequence select inputs, twelve target activate outputs, a target present output, an audio output, and a ready output adapted for providing digital logic signals at the twelve target activate outputs thereof so as to effect the activation of each of said linear motion targets and said pop-up targets in a predetermined sequence in accordance with a computer program utilized thereby, for providing a target present signal at the target present output thereof whenever one of said linear motion targets or one of said pop-up targets is activated thereby, and for providing a movement indicator signal at the audio output thereof whenever one of said linear motion targets or one of said pop-up targets is activated thereby;

a direct current voltage source having an output for providing a direct current voltage signal;

a selector switch having a first input connected to the output of said direct current voltage source, a second input connected to ground, and an output connected to the reset input of said first microprocessor computer for passing therethrough the direct current voltage signal provided by said direct current voltage source so as to initialize the computer program utilized by said first microprocessor computer;

a first logic gate having twelve inputs effectively and respectively connected the twelve target activate outputs of said first microprocessor computer, a thirteenth input connected to the output of said selector switch, and twelve outputs, six of which are respectively connected to the first inputs of said pop-up targets, three of which are respectively connected to the first inputs of said linear motion targets, and three of which are respectively connected to the second inputs of said linear motion targets for passing therethrough the digital logic signals provided by said first microprocessor computer only when said selector switch is positioned such that the direct current voltage signal provided by said direct current voltage source passes through said selector switch to the thirteenth input thereof;

a signal generator having an output for providing at the output thereof a clock signal having a predetermined frequency;

a second logic gate having twelve inputs effectively and respectively connected to the twelve outputs of said first logic gate, a thirteenth input connected to the output of said signal generator, and twelve outputs, six of which are respectively connected to the second inputs of said pop-up targets, three of which are respectively connected to the third inputs of said linear motion targets, and three of which are respectively connected to the fourth inputs of said linear motion targets for passing therethrough, in response to the digital logic signals provided by said first microprocessor computer, the clock signal provided by said signal generator so as to effect the activation of the pulsed beam of infrared light emitted from the linear motion or pop-up target activated by said first microprocessor computer;

an imitation weapon having a trigger mechanism for effecting the simulated firing thereof;

a sensor element mounted upon the barrel of said weapon, and having an output for receiving the pulsed beam of infrared light from the linear motion or pop-up target activated by said first microprocessor computer, and for providing at the output thereof an analog signal proportional to the amount of infrared light received thereby;

a rifle electronics circuit having an input connected to the output of sensor element, and an output for converting the analog signal provided by said sensor element to a digital logic signal;

an interface circuit having a target present input connected to the target present output of said first microprocessor computer, a data input connected to the output of said rifle electronics circuit, an input-output terminal, and an audio output adapted for passing therethrough the target present signal provided by said first microprocessor computer, and the digital logic signal converted by said rifle electronics circuit;

a second microprocessor computer having an input-output terminal connected to the input-output terminal of said interface circuit adapted for processing, in accordance with a predetermined computer program, the digital logic signal and the target present signal passed through said interface circuit so as to generate a logic indicator signal indicative of whether said marksman has scored a hit, a miss, or a near miss upon the linear motion or pop-up target activated by said first microprocessor computer;

a bang circuit having an input connected to the audio output of said first microprocessor computer, and an output for providing an audio signal at the output thereof in response to the movement indicator signal provided by said first microprocessor computer;

a voice unit having an input connected to the audio output of said interface circuit and an output for providing an audio signal at the output thereof in response to the hit indicator signal generated by said second microprocessor computer;

an audio circuit having a pair of inputs, the first of which is connected to the output of said voice unit, and the second of which is connected to the output of said bang circuit for passing therethrough the audio signal provided by said bang circuit, and the audio signal provided by said voice unit; and a headphone adapted to be worn upon the head of said marksman, and having an input connected to the output of said audio circuit for converting the audio signal provided by said bang circuit to an audio message simulating a rifle shot so as to indicate to said marksman that either a pop-up target or a linear motion target has been activated by said first microprocessor computer, and for converting the audio signal provided by said voice unit to an audio message so as to indicate to said marksman whether a hit, a miss, or a near miss has been scored upon the linear motion target or pop-up target activated by said first microprocessor computer.

11. The target training system of claim 10 wherein each of said pop-up targets comprises:

a base mounted within said modelboard;

a pair of L shaped support brackets, the first of which is mounted upon one end of said base, and the second of which is mounted upon the opposite end of said base;

an aperture located within the first of said pair of L shaped support brackets;

a coil mounted upon the second of said pair of support brackets, said coil having an input effectively connected to one of the outputs of said first logic gate, and a shaft rotatably extending through the aperture of the first of said pair of support brackets;

a support block mounted upon the shaft of said coil;

a target fixedly attached to said support block; and a photodiode mounted upon said target, said photodiode having an input connected to one of the outputs of said second logic gate.

12. The target training system of claim 10 wherein each of said linear motion targets comprises:

a base mounted within said modelboard;

a pair of guide rod support blocks mounted upon said base, the first of which is located near one end of said base, and the second of which is located near the opposite end of said base;

a pair of parallel guide rods rigidly mounted between said pair iof guide rod support blocks;

a target support block having therein a pair of apertures, each of which has passing therethrough one of said pair of guide rods;

a pair of limit switch support blocks, the first of which is mounted upon said base adjacent the first of said pair of guide rod support blocks, and the second of which is mounted upon said base adjacent the second of said pair of guide rod support blocks;

a first limit switch mounted upon the first of said pair of limit switch support blocks, said first limit switch having an input connected to one of the outputs of said first logic gate, and an output;

a second limit switch mounted upon the second of said pair of limit switch support blocks, said second limit switch having an input connected to another of the outputs of said first logic gate, and an output;

a motor support bracket mounted upon one end of said base adjacent the first of said pair of guide rod support blocks, said motor support bracket having therein an aperture;

a motor mounted upon said motor support bracket, said motor having a shaft passing through the aperture of said motor support bracket, a first input connected to the output of said first limit switch, and a second input connected to the output of said second limit switch;

a first sprocket connected to the shaft of said motor, said first sprocket having a plurality of teeth;

a sprocket support bracket mounted upon the opposite end of said base adjacent the second of said pair of guide rod support blocks, said sprocket support bracket having therein an aperture;

a sprocket support shaft passing through the aperture of said sprocket support bracket;

a second sprocket connected to one end of said sprocket support shaft, said second sprocket having a plurality of teeth;

a collar connected to the opposite end of said sprocket support shaft;

a drive chain having one end thereof connected to one side of said target support block, the opposite end thereof connected to the opposite side of said target support, and the remainder thereof meshing with the teeth of said first sprocket and the teeth of said second sprocket;

a target fixedly attached to said target support block and passing through one of the slots located within the terrain surface of said modelboard, said target having a recess therein;

a pair of rectangular shaped arms adjustably mounted within the recess of said target;

a first photodiode mounted upon the first of said pair of rectangular shaped arms, said first photodiode having an input connected to one of the outputs of said second logic gate; and a second photodiode mounted upon the second of said pair of rectangular shaped arms, said second photodiode having an input connected to another of the outputs of said second logic gate.

13. The target training system of claim 10, wherein said first logic gate comprises twelve two-input AND gates, each of which has the first input thereof connected to one of the target activate outputs of said first microprocessor computer, and each of which has the second input thereof connected to the output of said selector switch.

14. The target training system of claim 10, wherein said second logic gate comprises twelve two-input AND gates, each of which has the first input thereof connected to one of the outputs of said first logic gate, and each of which has the second input thereof connected to the output of said signal generator.

15. The target training system of claim 10, wherein said imitation weapon is a rifle.

16. The target training system of claim 10, further characterized by:

a first normally open switch having an input connected to the output of said direct current voltage source, and an output connected to the first sequence select input of said first microprocessor computer;

a second normally open switch having an input connected to the output of said direct current voltage source, and an output connected to the second sequence select input of said first microprocessor computer; and a third normally open switch having an input connected to the output of said direct current voltage source, and an output connected to the third sequence select input of said first microprocessor computer.

17. The target training system of claim 10 further characterized by:

a first inverter having an input connected to the ready output of said first microprocessor computer, and an output;

a NAND gate having a first input connected to the output of said selector switch, a second input connected to the output of said first inverter, and an output;

a second inverter having an input connected to the output of said NAND gate, and an output;

a first photodiode having an input connected to the output of said direct current voltage source and the output of said second inverter, and an output connected to the input of said second inverter; and a second photodiode having an input connected to the output of said direct current voltage source, and an output connected to the input of said first photodiode.

* * * * *

340370 U 55
2/15/82 DUBUSS 17-337
2
OX: ART UNIT
EANETTE GATLING

2/17 12/20 IL 0102